US006751819B2

(12) United States Patent
Chuang

(10) Patent No.: US 6,751,819 B2
(45) Date of Patent: Jun. 22, 2004

(54) TOOL ASSEMBLY WITH A TIRE REPAIRING WRENCH

(76) Inventor: Louis Chuang, 7F-8, No. 20, Ta Lon Road, Taichung (TW)

( * ) Notice: Subject to any disclaimer, the term of this patent is extended or adjusted under 35 U.S.C. 154(b) by 0 days.

(21) Appl. No.: 10/014,623

(22) Filed: Oct. 22, 2001

(65) Prior Publication Data

US 2003/0074738 A1 Apr. 24, 2003

(51) Int. Cl.[7] ..... B25F 1/00

(52) U.S. Cl. ..... 7/100; 7/138; 7/168; 157/1.3; 81/177.4

(58) Field of Search ..... 7/100, 138, 167, 7/168, 170; 157/1.3; 81/177.4, 490

(56) References Cited

U.S. PATENT DOCUMENTS

| | | | | |
|---|---|---|---|---|
| 589,402 | A | 9/1897 | Badgley | |
| 607,599 | A | 7/1898 | Deitsch et al. | |
| 635,562 | A | 10/1899 | Marschütz | |
| 647,528 | A | 4/1900 | Schmidt | |
| 854,891 | A | 5/1907 | Huffman | |
| 1,337,769 | A | 4/1920 | Hemming | |
| 1,369,829 | A | 3/1921 | Minges | |
| 1,378,798 | A | 5/1921 | Kroh | |
| 1,398,583 | A | 11/1921 | Bovee | |
| 1,494,660 | A | 5/1924 | Brandstetter | |
| 1,500,852 | A | 7/1924 | Shephard | |
| 1,556,788 | A | 10/1925 | Halivarson | |
| 1,801,443 | A | 4/1931 | Mesinger | |
| 2,148,573 | A | 2/1939 | Mulcay | 81/71 |
| 2,173,042 | A | 9/1939 | Picard | 145/50 |
| 2,332,656 | A | 10/1943 | Mirando | 30/22 |
| 2,518,139 | A | 8/1950 | Hallowell et al. | 279/75 |
| 2,798,290 | A | 7/1957 | Bassett | 30/152 |
| 2,804,970 | A | 9/1957 | Kuc et al. | 206/16 |
| 2,828,855 | A | 4/1958 | Mosch | 206/38 |

(List continued on next page.)

FOREIGN PATENT DOCUMENTS

| | | |
|---|---|---|
| DE | 9318002 | 11/1993 |
| EP | 0191913 | 11/1985 |
| FR | 525527 | 10/1920 |
| FR | 787512 | 3/1935 |
| FR | 1361926 | 2/1963 |
| GB | 856223 | 12/1960 |
| WO | WO 83/01406 | 4/1983 |
| WO | WO 97/29887 | 8/1997 |

*Primary Examiner*—D. S. Meislin
(74) *Attorney, Agent, or Firm*—Alan D. Kamrath; Nikolai & Mersereau, P.A.

(57) ABSTRACT

A tool assembly includes a main body having two sidewalls. Two sets of tools are, respectively, rotatably mounted between first ends and second ends of the sidewalls. Each sidewall has an outwardly facing recessed section for detachably receiving a tire repairing tool in the preferred form of a tire lever. Tire patches are received in at least one of the tire levers for proceeding with tire patching when required. At least one of the tire levers includes a driving column for adjusting the bolts to which the tools are rotatably mounted. The tools include a chain repairer that may engage with the driving column of the tire lever for proceeding with chain repair.

17 Claims, 8 Drawing Sheets

U.S. PATENT DOCUMENTS

| | | | | | |
|---|---|---|---|---|---|
| 3,061,927 | A | | 11/1962 | Von Frankenberg | 30/156 |
| 3,257,991 | A | | 6/1966 | Mosch | 120/1 |
| 3,943,801 | A | | 3/1976 | Yates | 81/71 |
| 3,964,799 | A | | 6/1976 | Knapp | 308/2 R |
| 4,103,378 | A | | 8/1978 | Granados | 7/138 |
| 4,204,294 | A | | 5/1980 | Halverson | 15/185 |
| 4,238,862 | A | | 12/1980 | Leatherman | 7/128 |
| 4,384,499 | A | | 5/1983 | Shockley | 81/440 |
| 4,580,469 | A | | 4/1986 | Lordahl | 81/437 |
| 4,744,272 | A | | 5/1988 | Leatherman | 81/427.5 |
| 4,759,645 | A | | 7/1988 | Kuo | 385/396 |
| 4,811,638 | A | | 3/1989 | Ketzscher | 81/177.2 |
| 4,836,066 | A | | 6/1989 | Graham et al. | 81/177.4 |
| 4,854,045 | A | | 8/1989 | Schaub | 30/155 |
| 4,882,841 | A | | 11/1989 | Margolis | 30/125 |
| D304,898 | S | | 12/1989 | Brawner et al. | D8/26 |
| 4,888,869 | A | | 12/1989 | Leatherman | 30/161 |
| 4,908,947 | A | | 3/1990 | Schaub | 30/155 |
| 4,967,435 | A | | 11/1990 | Seals | 7/139 |
| 5,062,173 | A | | 11/1991 | Collins et al. | 7/118 |
| 5,140,736 | A | | 8/1992 | Hsiao | 29/243.54 |
| 5,146,815 | A | | 9/1992 | Scott, III | 81/437 |
| D332,211 | S | | 1/1993 | Scott, III | D8/105 |
| 5,251,341 | A | | 10/1993 | Seals | 7/138 |
| 5,263,389 | A | | 11/1993 | Frazzell et al. | 81/124.3 |
| 5,271,300 | A | | 12/1993 | Zurbuchen et al. | 81/124.4 |
| 5,303,439 | A | | 4/1994 | Seals | 7/138 |
| 5,313,860 | A | | 5/1994 | Liou | 81/437 |
| 5,320,004 | A | | 6/1994 | Hsiao | 81/440 |
| 5,329,834 | A | | 7/1994 | Wong | 81/58.3 |
| 5,385,071 | A | | 1/1995 | Her | 81/177.7 |
| 5,428,853 | A | | 7/1995 | Menke et al. | 7/138 |
| 5,442,982 | A | | 8/1995 | Bell | 81/439 |
| 5,450,774 | A | | 9/1995 | Chang | 81/440 |
| 5,477,758 | A | | 12/1995 | Cunningham | 81/177.85 |
| 5,495,942 | A | * | 3/1996 | Izhak | 81/440 |
| 5,553,340 | A | | 9/1996 | Brown, Jr. | 7/118 |
| 5,581,834 | A | | 12/1996 | Collins | 7/118 |
| 5,588,169 | A | | 12/1996 | Chuang | 7/138 |
| 5,592,859 | A | | 1/1997 | Johnson et al. | 81/177.4 |
| 5,632,056 | A | | 5/1997 | Hsiao | 7/138 |
| D382,180 | S | | 8/1997 | Chuang | D8/26 |
| 5,655,242 | A | | 8/1997 | Chuang | 7/138 |
| 5,669,492 | A | | 9/1997 | Chao | 206/234 |
| 5,685,206 | A | | 11/1997 | Ma | 81/77 |
| 5,711,042 | A | * | 1/1998 | Chuang | 7/138 |
| 5,711,194 | A | | 1/1998 | Anderson et al. | 81/440 |
| D394,952 | S | | 6/1998 | Wei | D3/273 |
| 5,787,535 | A | | 8/1998 | Epstein | 7/118 |
| 5,791,211 | A | | 8/1998 | Bondhus et al. | 81/440 |
| 5,802,936 | A | | 9/1998 | Liu | 81/450 |
| 5,806,380 | A | | 9/1998 | Wilsey | 81/3.09 |
| D400,775 | S | | 11/1998 | Hsu | D8/107 |
| D401,133 | S | | 11/1998 | Gardiner et al. | D8/105 |
| 5,842,394 | A | * | 12/1998 | Hwang | 81/490 |
| D406,508 | S | | 3/1999 | Rivera | D8/52 |
| 5,887,306 | A | | 3/1999 | Huang | 7/165 |
| D408,238 | S | | 4/1999 | Rivera | D8/52 |
| D410,369 | S | | 6/1999 | Yeh | D8/55 |
| 5,918,513 | A | | 7/1999 | Ho | 81/490 |
| 5,920,935 | A | | 7/1999 | Beck | 7/128 |
| 5,927,162 | A | | 7/1999 | Huang | 81/177.8 |
| D412,823 | S | | 8/1999 | Liao | D8/107 |
| 5,960,498 | A | * | 10/1999 | Nabors et al. | 7/128 |
| 5,970,553 | A | | 10/1999 | Lin | 7/143 |
| 5,970,828 | A | | 10/1999 | Bondhus et al. | 81/440 |
| 6,006,385 | A | | 12/1999 | Kershaw et al. | 7/129 |
| 6,009,582 | A | | 1/2000 | Harrison et al. | 7/118 |
| 6,014,787 | A | | 1/2000 | Rivera | 7/128 |
| D420,874 | S | | 2/2000 | Berg et al. | D8/52 |
| D421,377 | S | | 3/2000 | Rivera | D8/58 |
| 6,032,332 | A | | 3/2000 | Lin | 16/111.1 |
| 6,044,508 | A | | 4/2000 | Chuang | 7/138 |
| 6,047,426 | A | | 4/2000 | McIntosh et al. | 7/129 |
| 6,047,619 | A | | 4/2000 | Anderson et al. | 81/440 |
| 6,065,213 | A | | 5/2000 | Rivera | 30/155 |
| 6,076,665 | A | | 6/2000 | Chuang | 206/234 |
| D427,496 | S | | 7/2000 | Berg | D8/52 |
| D427,501 | S | | 7/2000 | Berg et al. | D8/105 |
| D427,868 | S | | 7/2000 | Rivera | D8/52 |
| D427,875 | S | | 7/2000 | Chiu | D8/105 |
| 6,092,444 | A | | 7/2000 | Hsiao | 81/440 |
| RE36,797 | E | | 8/2000 | Egert et al. | 81/438 |
| D428,791 | S | | 8/2000 | Anderson et al. | D8/107 |
| D429,131 | S | | 8/2000 | Rivera | D8/58 |
| D429,132 | S | | 8/2000 | Rivera | D8/58 |
| D429,616 | S | | 8/2000 | Rivera | D8/105 |
| D429,621 | S | | 8/2000 | Rivera | D8/343 |
| D429,989 | S | | 8/2000 | Rivera | D8/105 |
| 6,112,351 | A | * | 9/2000 | Hawkins et al. | 7/138 |
| 6,119,560 | A | * | 9/2000 | Anderson et al. | 7/168 |
| D432,214 | S | | 10/2000 | Hawkins et al. | D3/294 |
| 6,128,805 | A | | 10/2000 | Rivera | 16/111.1 |
| 6,128,981 | A | | 10/2000 | Bondhus et al. | 81/440 |
| D433,902 | S | | 11/2000 | Rivera | D8/52 |
| 6,151,998 | A | * | 11/2000 | Fu-Hui | 81/490 |
| 6,161,273 | A | | 12/2000 | Rivera et al. | 29/525.06 |
| D436,514 | S | | 1/2001 | Rivera | D8/105 |
| D437,541 | S | | 2/2001 | Hermansen et al. | D8/105 |
| D440,141 | S | | 4/2001 | Yeh | D8/105 |
| 6,216,301 | B1 | | 4/2001 | Rivera | 7/128 |
| 6,220,127 | B1 | | 4/2001 | Berg et al. | 81/427.5 |
| RE37,210 | E | | 6/2001 | Chuang | 7/138 |
| 6,243,902 | B1 | | 6/2001 | Huang | 7/165 |
| 6,286,168 | B1 | | 9/2001 | Woodruff et al. | 7/138 |
| 6,286,397 | B1 | | 9/2001 | Taggart et al. | 81/63.1 |
| 6,311,587 | B1 | | 11/2001 | Johnson et al. | 81/177.4 |
| 6,352,010 | B1 | | 3/2002 | Giarritta et al. | 81/177.4 |
| D459,967 | S | | 7/2002 | Johnson et al. | D8/71 |
| 6,490,954 | B2 | | 12/2002 | Johnson et al. | 81/177.4 |
| 6,520,053 | B2 | | 2/2003 | Liao | 81/177.9 |
| 6,520,054 | B1 | | 2/2003 | Wang | 81/440 |
| 6,564,678 | B1 | | 5/2003 | Wang | 81/124.4 |
| D476,215 | S | | 6/2003 | Chuang | D8/105 |
| 6,574,817 | B2 | | 6/2003 | Wu | 7/138 |
| 6,601,481 | B2 | | 8/2003 | Chuang | 81/440 |
| 6,622,329 | B2 | | 9/2003 | Ostor et al. | 7/138 |
| 2003/0066396 | A1 | | 4/2003 | Chuang | 81/440 |
| 2003/0074738 | A1 | | 4/2003 | Chuang | 7/100 |

* cited by examiner

TOOL ASSEMBLY WITH A TIRE REPAIRING WRENCH

BACKGROUND OF THE INVENTION

1. Field of the Invention

The present invention relates to a tool assembly with a tire repairing tool in the most preferred form of a tire lever. In particular, the present invention relates to a tool assembly comprising at least one set of folding tools rotatably attached thereto and a tire lever detachably attached thereto in an ergonomic manner for proceeding with tire patching.

2. Description of the Related Art

FIG. 8 of the drawings illustrates a conventional so-called "folding tool" that comprises a main body 10', a set of tools 40' rotatably mounted to an end of the main body 10' by a bolt 20', and a chain repairer 50' mounted to the other end of the main body 10'. The folding tool is convenient to repair bicycles, and the tools 40' are received in a compartment 15' in the main body 10' when not in use. A tire lever 30' is attached to a side of the folding tool to provide a tire patching function. However, the folding tool thus constructed is not ergonomic such that the user does not feel comfortable when holding the folding tool for operation. Further, the chain repairer is rotated in an axis transverse to the main body 10', which inevitably increases the overall width of the folding tool.

SUMMARY OF THE INVENTION

An object of the present invention is to provide a tool assembly that includes a main body having two sidewalls. Two sets of tools are respectively, rotatably mounted between first ends and second ends of the sidewalls. Each sidewall has an outwardly facing recessed section for detachably receiving a tire repairing tool in the preferred form of a tire lever. Tire patches are received in at least one of the tire levers for proceeding with tire patching when required. At least one of the tire levers includes a driving column for adjusting the bolts to which the tools are rotatably mounted. The tools include a chain repairer that may engage with the driving column of the tire repairing wrench for proceeding with chain repair.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
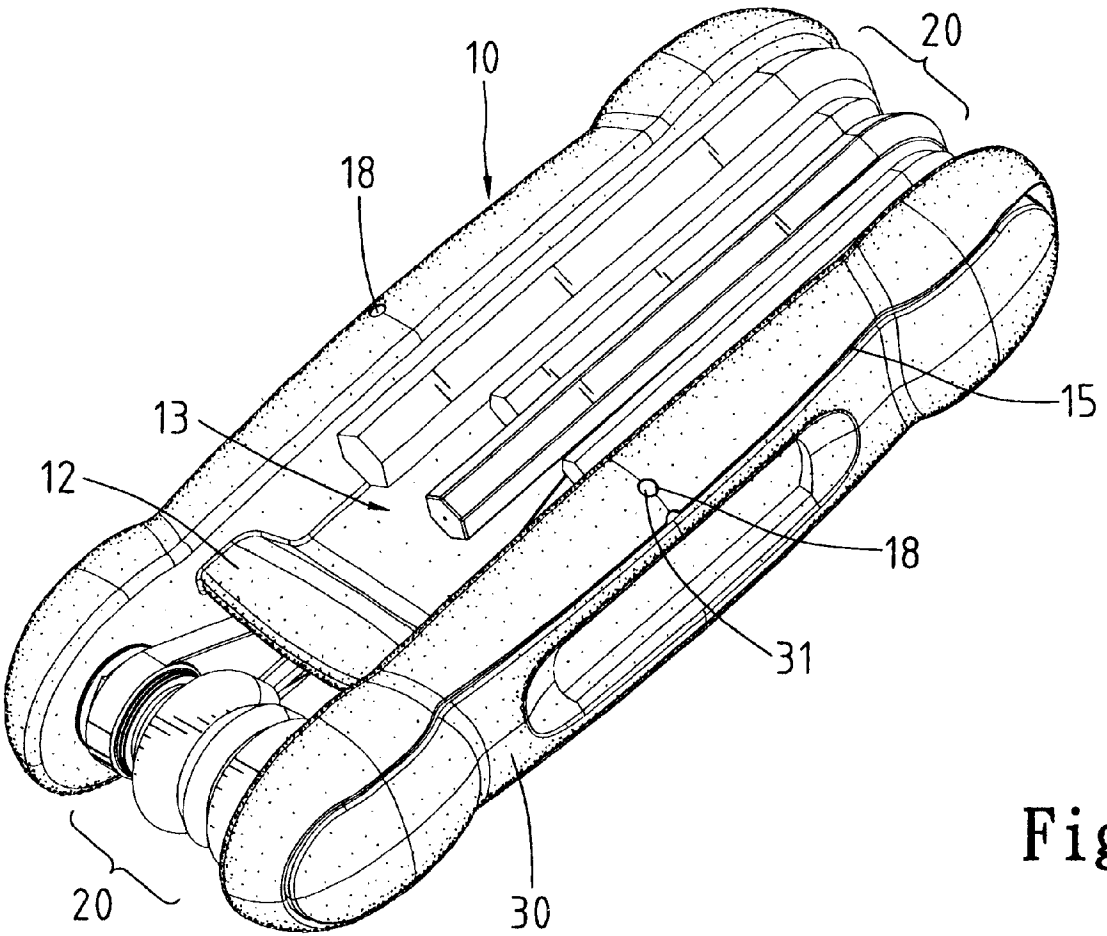
FIG. 1 is a perspective view of a tool assembly in accordance with the present invention.
Figure 2:
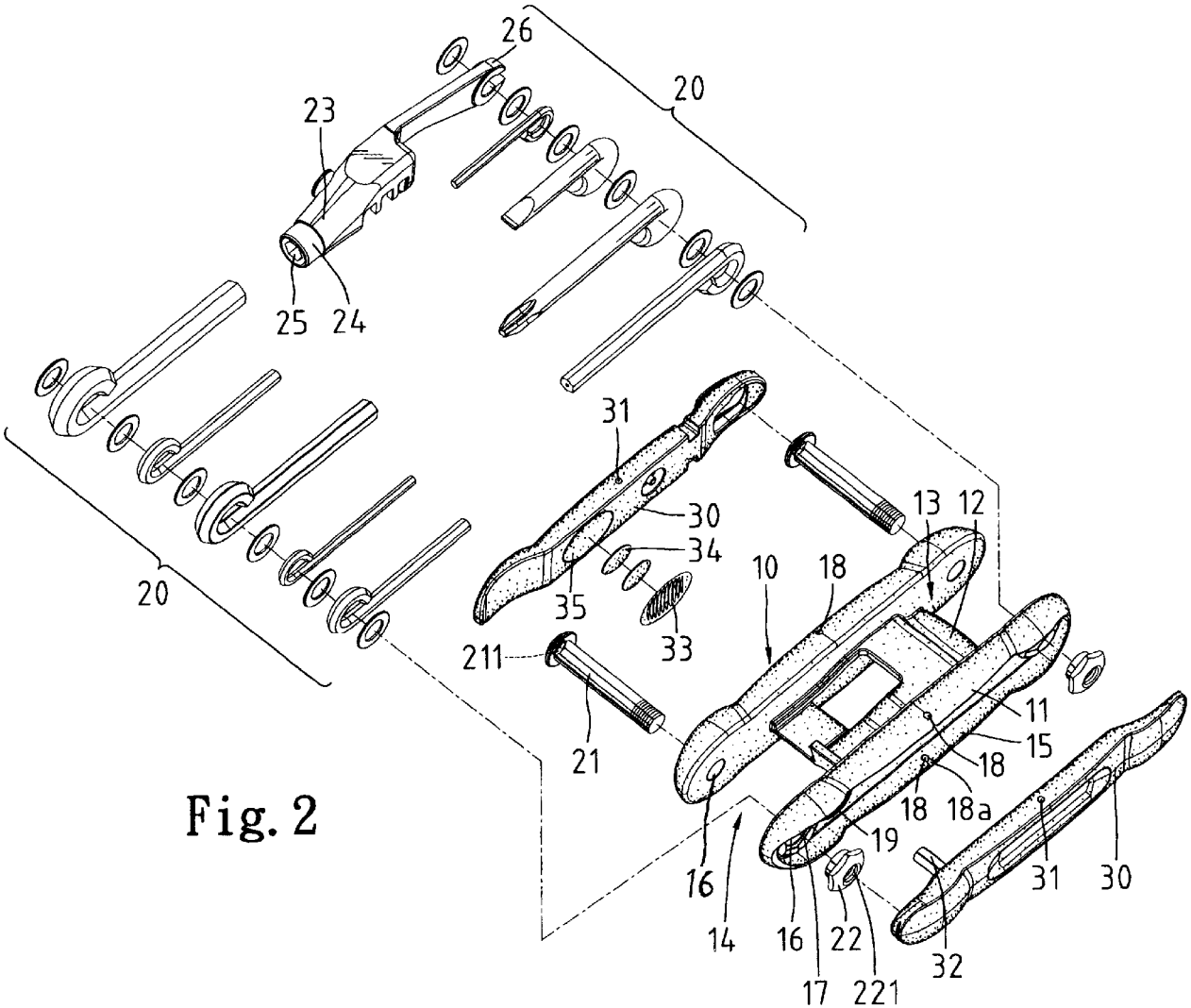
FIG. 2 is an exploded perspective view of the tool assembly in accordance with the present invention.

Referring to FIGS. 1 and 2, a tool assembly in accordance with the present invention generally includes a main body 10 having a base 12 and two sidewalls 11 on both sides of the base 12. Thus, two compartments 13 and 14 are defined between the sidewalls 11. Each sidewall 11 has an outwardly facing recessed section 15 for detachably receiving a tire repairing tool in the preferred form of a tire lever 30. Each sidewall 11 further includes a first end and a second end. A through-hole 16 is defined in each of the first end and the second end of each sidewall 11. Each through-hole 16 of one of the sidewalls 11 (e.g., the right one in FIG. 2) has a hexagonal countersink 17 for securely retaining a nut 22 in place. Each sidewall 11 further includes an engaging hole 18 in each of two lateral sides defining the recessed section 15. Further, each lateral side defining the recessed section 15 includes a guide groove 18*a* having a first end communicated with outside and a second end communicated with the respective engaging hole 18. Further, a hole 19 is defined in a bottom defining said one of the sidewalls 11.

A first set of tools 20 is rotatably attached between the first ends of the sidewalls 11. A bolt 21 is extended through the holes 16 of the first ends of the sidewalls 11. A threaded end of the bolt 21 is threadedly engaged with a screw hole 221 of the nut 22 in the respective hexagonal countersink 17. The bolt 21 has a hexagonal groove 211 in the other end thereof.

Similarly, a second set of tools 20 is rotatably attached between the second ends of the sidewalls by another bolt 21. The arrangement of the second set of tools 20 and corresponding elements is identical to that of the first set of tools 20. Each of the first set and the second set of tools 20 may include tools for repairing, e.g., bicycles. In this embodiment, the second set of tools 20 includes a chain repairer 23 (e.g., a chain rivet extractor) that comprises an operative rod 24 having an engaging portion, which is conventional and therefore not further described. The tools 20 are received in the compartments 13 and 14 of the main body 10 when not in use.

Figure 3:
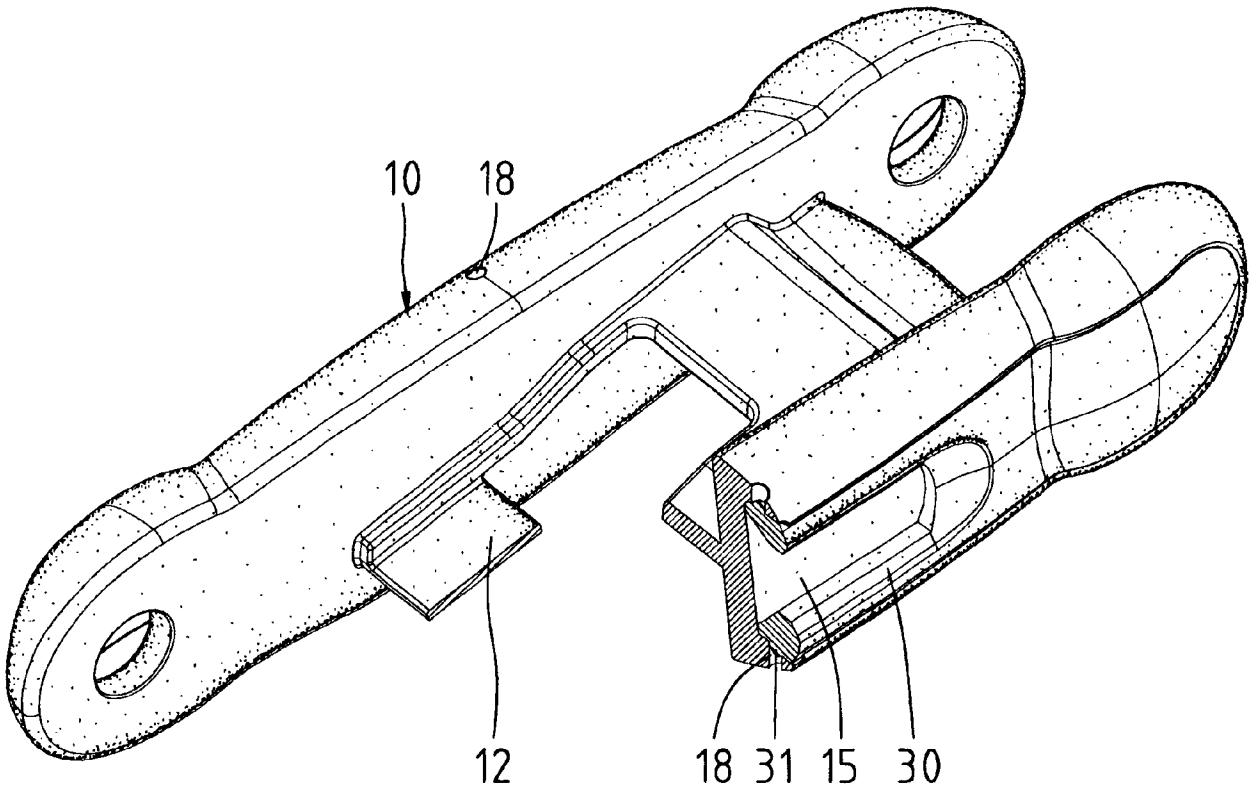
FIG. 3 is a perspective view, partly cutaway, of a main body of the tool assembly in accordance with the present invention.
Figure 4:
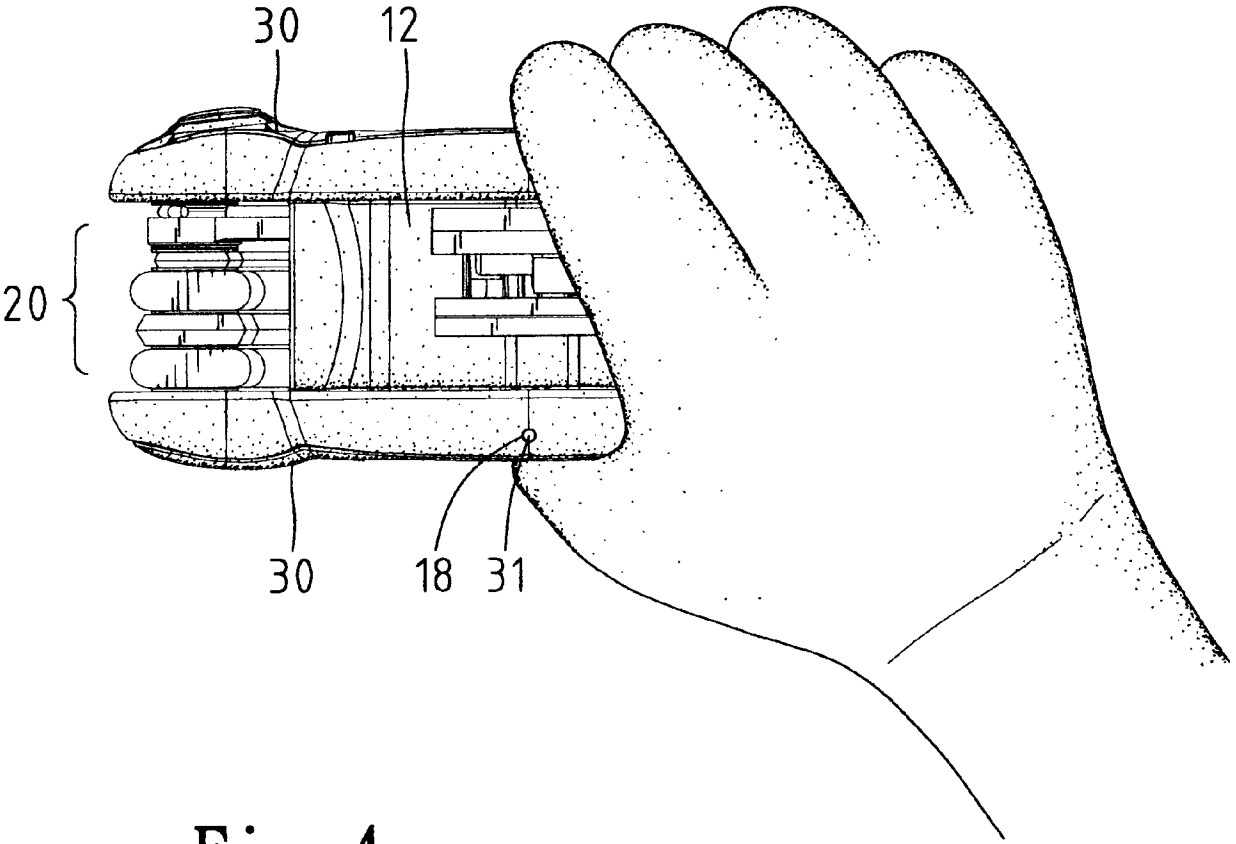
FIG. 4 is a schematic view illustrating use of the tool assembly in accordance with the present invention.
Figure 6:
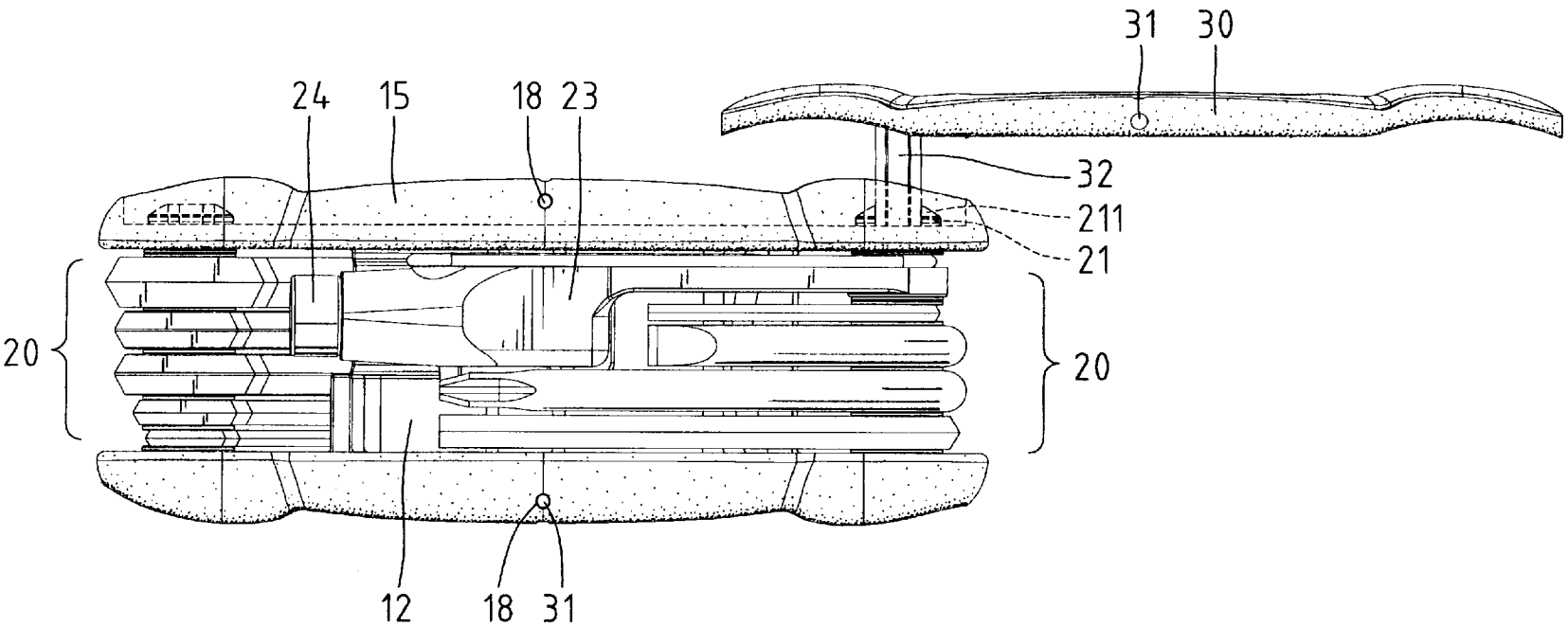
FIG. 6 is a top view illustrating adjustment of tightness of a bolt of the tool assembly.

Each tire lever 30 comprises two protrusions 31 on both sides thereof for releasably engaging with the engaging holes 18 of an associated one of the recessed sections 15, as shown in FIG. 3. Each protrusion 31 is slidable along a respective guide groove 18*a* into the respective engaging hole 18. Thus, the tire lever 30 is received in the associated recessed section 15 when not in use. As illustrated in FIG. 1, an outer face of the tire lever 30 is flush with an outer face of the associated sidewall 11, thereby providing a streamlined outline for easy holding during operation, best shown in FIG. 4. One of the tire levers 30 includes a driving column 32 for engaging with the hexagonal groove 211 of each bolt 21. Thus, the tire lever 30 may adjust tightness of the bolts 21 when loosened, as shown in FIG. 6. Namely, the tightness between the main body 10 and the set of tools 20 is adjusted. The driving column 32 is received in the hole 19 of the associated recessed section 15 when not in use. In addition, at least one of the tire levers 30 may include a compartment 35 for accommodating tire patches 34, the compartment 35 being enclosed by a cap 33. Thus, tire patching can be proceeded with at any time.

Figure 5:
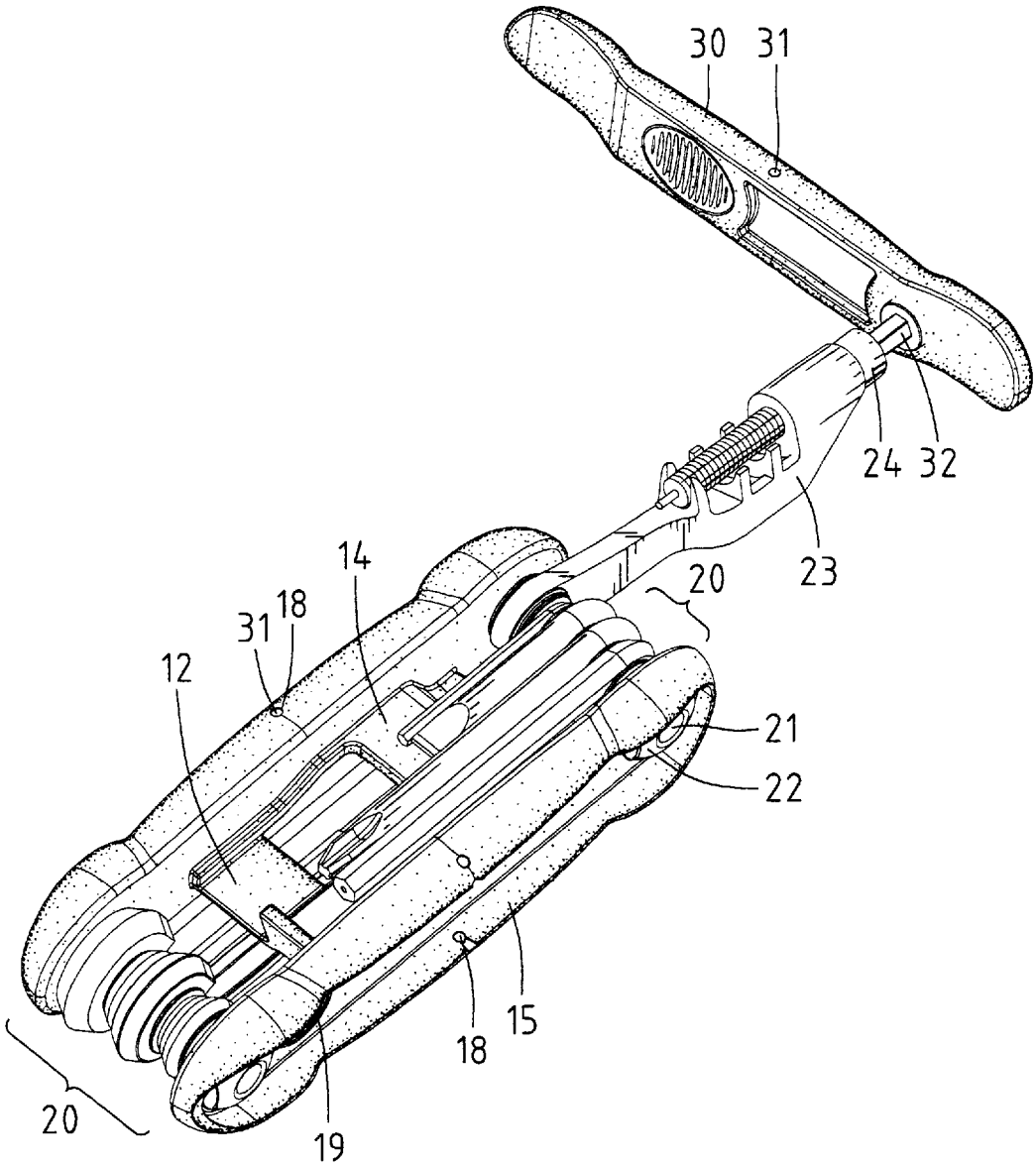
FIG. 5 is a schematic perspective view of the tool assembly in a state for repairing a chain.

FIG. 5 illustrates use of the chain repairer 23, wherein the driving column 32 of the tire lever 30 is engaged with the engaging section 25 of the operative rod 24 of the chain repairer 23 to proceed with chain repair. Such a design largely reduces the overall size of the chair repairer 23 when compared with a conventional tool assembly. As illustrated in FIG. 2, the chain repairer 23 may include a C-shaped end 26 for rapid, releasable engagement with the bolt 21.

Figure 7:
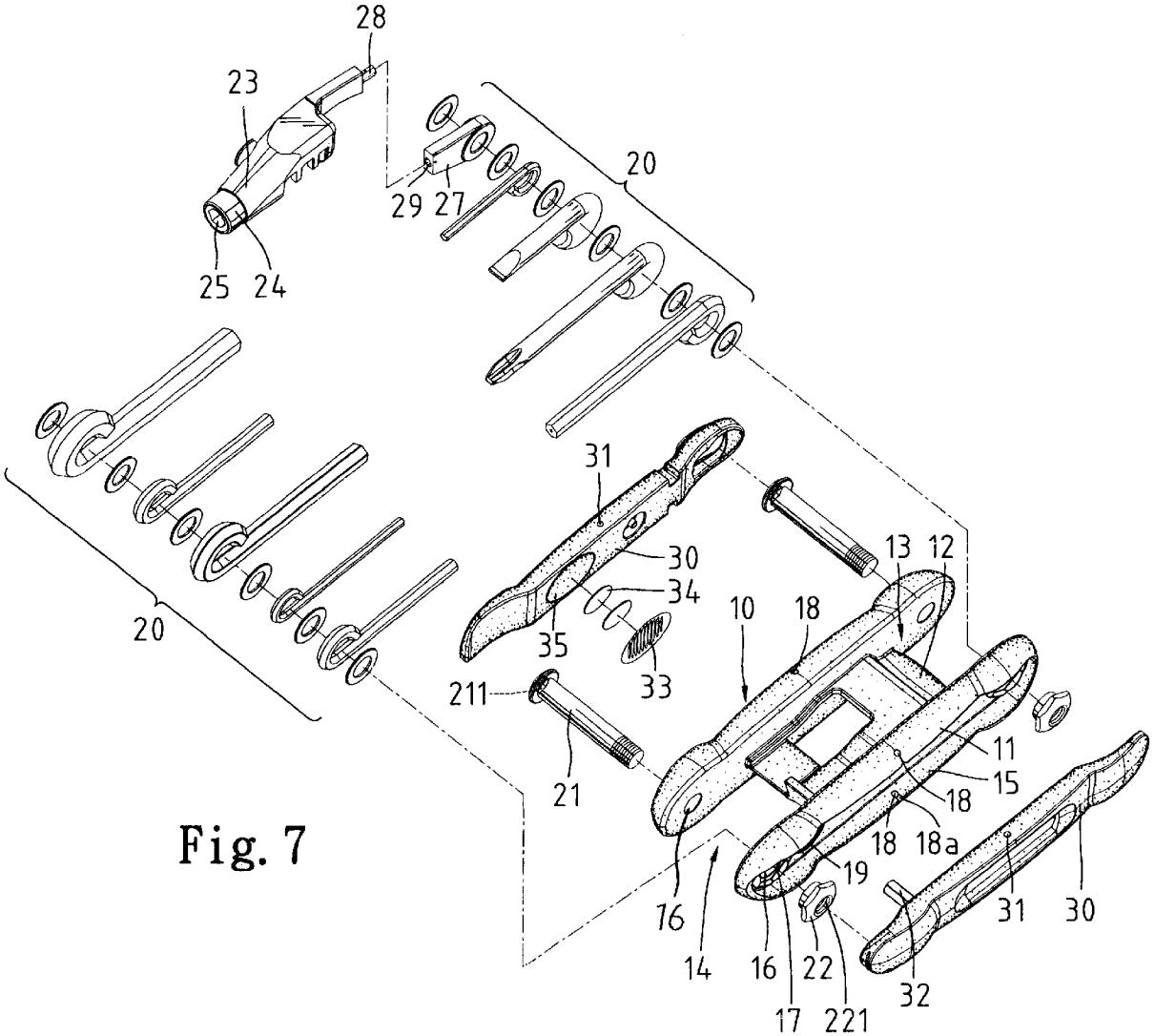
FIG. 7 is an exploded perspective view illustrating a modified embodiment of the tool assembly in accordance with the present invention.
Figure 8:
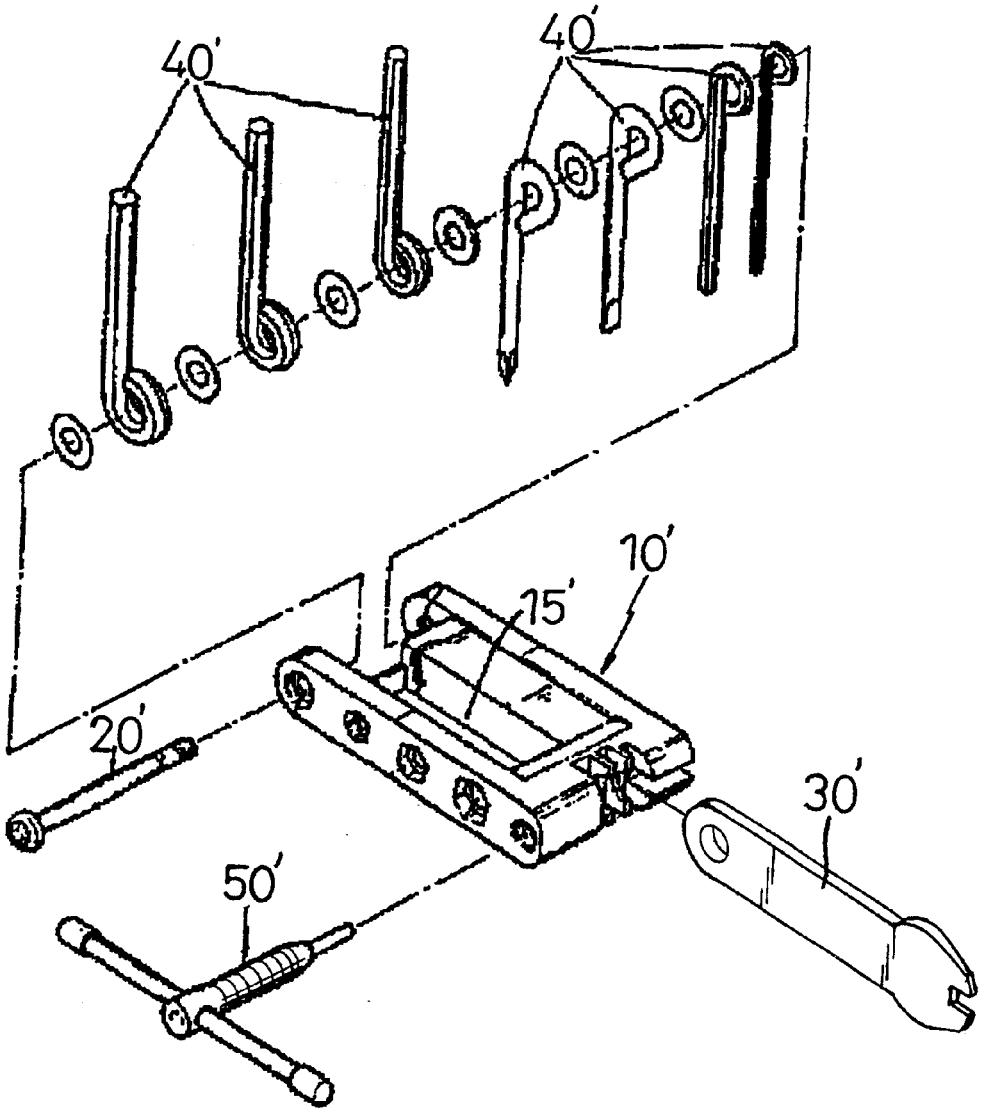
Fig. 8 PRIOR ART
FIG. 8 is an exploded perspective view of a conventional folding tool.

FIG. 7 illustrates a modified embodiment of the invention, wherein the chain repairer 23 comprises an attaching section 27 pivotally mounted to the bolt 21 and an operative section having an engaging end 28 for releasably engaging with an engaging hole 29 in the attaching section 27. Thus, the chain repairer 23 may be detached from the tool set 20 and engaged with one of the tire repairing wrenches to proceed with chain repair, if necessary.

Although the invention has been explained in relation to its preferred embodiment, it is to be understood that many other possible modifications and variations can be, made without departing from the scope of the invention as hereinafter claimed.

What is claimed is:

1. A tool assembly comprising:

a main body formed as a single, integral component and comprising a base and two sidewalls located on opposite sides of the base, with portions of the sidewalls being separated by the base, with each sidewall having first and second ends and an outer face extending between the first and second ends and opposite the base, with each outer face being engageable by a user's hand;

at least one recessed section formed in the outer face of one of the sidewalls of the main body and intermediate the first and second ends of said one of the sidewalls of the main body; and at least one tire lever detachably received in said at least one recessed section, said at least one tire lever having a continuous outer face that is flush with the outer face of said at least one recessed section when said at least one tire lever is received in said at least one recessed section, thereby providing a streamlined outline for the main body for easy holding during operation of the tool assembly.

2. The tool assembly as claimed in claim 1, wherein each of two lateral sides defining said at least one recessed section comprises an engaging hole, with said at least one tire lever comprising two sides each having a protrusion for releasably engaging with an associated one of the engaging holes.

3. The tool assembly as claimed in claim 1, wherein the main body comprises a bolt mounted between the first ends of the two sidewalls of the main body, with the tool assembly further comprising a chain repairer pivotably mounted and detachably attached to the bolt, said at least one tire lever cooperating with the chain repairer to proceed with chain repair.

4. The tool assembly as claimed in claim 3, wherein the chain repairer comprises a C-shaped end for releasable engagement with the bolt.

5. The tool assembly as claimed in claim 3, wherein the chain repairer comprises an attaching section pivotally mounted to the bolt and having an engaging hole, with the chain repairer further comprising an operative section having an engaging end for releasably engaging with the engaging hole in the attaching section.

6. The tool assembly as claimed in claim 1, with said at least one tire lever having an inner face opposite to the continuous outer face, with said at least one tire lever including a compartment formed in the inner face and enclosed by a cap, with the compartment accommodating tire patches, with the inner face and the cap located within the at least one recessed section when the at least one tire lever is received therein.

7. The tool assembly as claimed in claim 1, further comprising:

a bolt mounted between the first ends of the two sidewalls, with the bolt having a tightening groove, with said at least one tire lever having an inner face opposite to the continuous outer face; and a driving column extending from the inner face of said at least one tire lever, with the driving column having a shape for engaging with the tightening groove of the bolt.

8. The tool assembly as claimed in claim 7, with the at least one tire lever being insertable in the at least one recessed section in an installation direction, with the driving column integrally formed with the inner face and extending rigidly relative to the inner face and in the installation direction when the at least one tire lever is received in said at least one recessed section, with the at least one recessed section including a hole extending in the installation direction for receipt of the driving column.

9. The tool assembly as claimed in claim 1, further comprising:

a driving column extending from an inner face of said at least one tire lever, with the inner face being opposite to the continuous outer face, with the at least one tire lever being insertable in the at least one recessed section in an installation direction, with the driving column integrally formed with the inner face and extending rigidly relative to the inner face and in the installation direction when the at least one tire lever is received in said at least one recessed section, with the at least one recessed section including a hole extending in the installation direction for receipt of the driving column.

10. A tool assembly comprising:

a main body, with the main body including a hole;

at least one bolt mounted to the main body; and at least one set of tools rotatably mounted to said at least one bolt and including a chain repairer; and at least one tire repairing tool detachably mounted to said main body, said at least one tire repairing tool comprising a driving column for engaging with the chain repairer to proceed with chain repair, with the driving column being received in the hole of the main body when the at least one tire repairing tool is mounted to said main body.

11. The tool assembly as claimed in claim 10, wherein the main body comprises at least one recessed section in an outer face thereof for receiving said at least one tire repairing tool, with said at least one tire repairing tool having an outer face that is flush with the outer face of said at least one recessed section when said at least one tire repairing tool is received in said at least one recessed section, thereby providing a streamlined outline for the main body, with the hole located in said at least one recessed section.

12. The tool assembly as claimed in claim 11, wherein each of two lateral sides defining said at least one recessed section comprises an engaging hole, with said at least one tire repairing tool comprising two sides each having a protrusion for releasably engaging with an associated one of the engaging holes.

13. The tool assembly as claimed in claim 11, wherein the main body comprises a base and two sidewalls, with said at least one recessed section being defined in at least one of the sidewalls of the main body.

14. The tool assembly as claimed in claim 10, wherein the main body comprises at least one recessed section in an outer face thereof for receiving said at least one tire repairing tool, with said at least one tire repairing tool including an inner face opposite to an outer face of said at least one tire repairing tool, wherein the driving column is formed on and integrally extends from the inner face of said at least one tire repairing tool in a nonmoveable manner, with the inner face of said at least one tire repair tool being received in said at least one recessed section when said at least one tire repairing tool is received in said at least one recessed section, thereby providing a streamlined outline for the main body.

15. The tool assembly as claimed in claim 10, wherein the chain repairer comprises a C-shaped end for releasable engagement with the bolt.

16. The tool assembly as claimed in claim 10, wherein the chain repairer comprises an attaching section pivotally mounted to the bolt and having an engaging hole, the chain repairer further comprising an operative section having an engaging end for releasably engaging with the engaging hole in the attaching section.

17. The tool assembly as claimed in claim 10, with the at least one tire repairing tool being mounted to said body by movement in an installation direction, with the driving column integrally formed with the at least one tire repairing tool and extending rigidly relative to the at least one tire repairing tool and in the installation direction when the at least one tire repairing tool is mounted to said main body, with the hole of the main body extending in the installation direction for receipt of the driving column.

* * * * *